US010662391B2

(12) United States Patent
Carabell

(10) Patent No.: US 10,662,391 B2
(45) Date of Patent: May 26, 2020

(54) LUBRICATING OIL COMPOSITIONS CONTAINING BORATED DISPERSANTS AND AMINE COMPOUNDS AND METHODS OF MAKING AND USING SAME

(71) Applicant: Chevron Oronite Company LLC, San Ramon, CA (US)

(72) Inventor: Kevin David Carabell, Fairfax, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 1 day.

(21) Appl. No.: 15/437,728

(22) Filed: Feb. 21, 2017

(65) Prior Publication Data

US 2018/0237716 A1 Aug. 23, 2018

(51) Int. Cl.
*C10M 141/12* (2006.01)

(52) U.S. Cl.
CPC .. *C10M 141/12* (2013.01); *C10M 2203/1025* (2013.01); *C10M 2207/026* (2013.01); *C10M 2207/028* (2013.01); *C10M 2215/04* (2013.01); *C10M 2215/042* (2013.01); *C10M 2215/064* (2013.01); *C10M 2215/086* (2013.01); *C10M 2215/28* (2013.01); *C10M 2219/046* (2013.01); *C10M 2223/045* (2013.01); *C10M 2227/061* (2013.01); *C10N 2220/021* (2013.01); *C10N 2230/02* (2013.01); *C10N 2230/12* (2013.01); *C10N 2230/52* (2013.01); *C10N 2240/10* (2013.01); *C10N 2260/14* (2013.01)

(58) Field of Classification Search
CPC ..... C10M 139/00; C10M 141/12; C10M 2227/00; C10M 2215/02; C10M 2215/042; C10M 2227/061; C10M 2219/04; C10M 2207/042; C10M 2215/08; C10M 2201/087; C10N 2230/04; C10N 2230/06; C10N 2230/12; C10N 2230/52; C10N 2240/10
See application file for complete search history.

(56) References Cited

U.S. PATENT DOCUMENTS

| | | | | |
|---|---|---|---|---|
| 3,087,936 | A | 4/1963 | Le Suer et al. | |
| 3,254,025 | A | 5/1966 | Le Suer et al. | |
| 3,313,727 | A | 4/1967 | Peeler et al. | |
| 3,819,521 | A | 6/1974 | Sims | |
| 3,853,772 | A | 12/1974 | Adams | |
| 3,907,601 | A | 9/1975 | Schaefer | |
| 3,933,659 | A * | 1/1976 | Lyle | C10M 163/00 508/294 |
| 3,997,454 | A | 12/1976 | Adams | |
| 4,085,126 | A | 4/1978 | McConnell et al. | |
| 4,089,790 | A | 5/1978 | Adams | |
| 4,320,019 | A | 3/1982 | Hayashi | |
| 5,078,893 | A * | 1/1992 | Ryer | C10M 141/10 508/195 |
| 6,534,450 | B1 | 3/2003 | Harrison et al. | |
| 6,737,387 | B2 | 5/2004 | Harrison et al. | |
| 7,479,473 | B2 | 1/2009 | Queen | |
| 9,145,530 | B2 | 9/2015 | Bera et al. | |
| 2007/0123437 | A1 | 5/2007 | Boffa et al. | |
| 2013/0252865 | A1 | 9/2013 | Hartley et al. | |
| 2014/0051621 | A1 | 2/2014 | DeSantis et al. | |
| 2014/0106996 | A1 | 4/2014 | DeSantis et al. | |

* cited by examiner

*Primary Examiner* — Cephia D Toomer
(74) *Attorney, Agent, or Firm* — Ryan, Mason & Lewis, LLP

(57) ABSTRACT

The present disclosure generally relates to a lubricating oil composition for improving corrosion resistance and maintaining TBN in an internal combustion engine.

14 Claims, No Drawings

LUBRICATING OIL COMPOSITIONS CONTAINING BORATED DISPERSANTS AND AMINE COMPOUNDS AND METHODS OF MAKING AND USING SAME

BACKGROUND OF THE DISCLOSURE

Field of the Disclosure

The present disclosure generally relates to a lubricating oil composition for improving corrosion resistance and maintaining TBN in an internal combustion engine.

Summary of the Disclosure

In accordance with one embodiment of the present disclosure, there is provided a lubricating oil composition which comprises: (a) a major amount of an oil of lubricating viscosity; (b) an oil soluble or oil dispersible borated hydrocarbyl succinimide dispersant, wherein the hydrocarbyl group has a number average molecular weight of from about 550 to about 1150; and (c) an oil soluble or oil dispersible tertiary hydrocarbylamine compound.

Also provided is a lubricating oil composition which comprises (a) a major amount of an oil of lubricating viscosity; (b) an oil soluble or oil dispersible borated hydrocarbyl succinimide dispersant, wherein the hydrocarbyl group has a number average molecular weight of greater than 1150 to about 5000; and (c) an oil soluble or oil dispersible tertiary hydrocarbylamine compound, wherein the boron content of the lubricating oil composition is less than about 470 ppm.

DETAILED DESCRIPTION OF THE DISCLOSURE

Definitions

As used herein, the following terms have the following meanings, unless expressly stated to the contrary:

The term "a major amount" of a base oil refers to where the amount of the base oil is at least 40 wt. % of the lubricating oil composition. In some embodiments, "a major amount" of a base oil refers to an amount of the base oil more than 50 wt. %, more than 60 wt. %, more than 70 wt. %, more than 80 wt. %, or more than 90 wt. % of the lubricating oil composition.

In the following description, all numbers disclosed herein are approximate values, regardless whether the word "about" or "approximate" is used in connection therewith. They may vary by 1 percent, 2 percent, 5 percent, or, sometimes, 10 to 20 percent.

As used herein, the terms "hydrocarbon", "hydrocarbyl" or "hydrocarbon based" mean that the group being described has predominantly hydrocarbon character within the context of this disclosure. These include groups that are purely hydrocarbon in nature, that is, they contain only carbon and hydrogen. They may also include groups containing substituents or atoms which do not alter the predominantly hydrocarbon character of the group. Such substituents may include halo-, alkoxy-, nitro-, etc. These groups also may contain hetero atoms. Suitable hetero atoms will be apparent to those skilled in the art and include, for example, sulfur, nitrogen and oxygen. Therefore, while remaining predominantly hydrocarbon in character within the context of this disclosure, these groups may contain atoms other than carbon, present in a chain or ring otherwise composed of carbon atoms.

In general, no more than about three non-hydrocarbon substituents or hetero atoms, and preferably no more than one, will be present for every 10 carbon atoms in the hydrocarbon or hydrocarbon based groups. Most preferably, the groups are purely hydrocarbon in nature, that is they are essentially free of atoms other than carbon and hydrogen.

Throughout the specification and claims the expression oil soluble or dispersible is used. By oil soluble or dispersible is meant that an amount needed to provide the desired level of activity or performance can be incorporated by being dissolved, dispersed or suspended in an oil of lubricating viscosity. Usually, this means that at least about 0.001% by weight of the material can be incorporated in a lubricating oil composition. For a further discussion of the terms oil soluble and dispersible, particularly "stably dispersible", see U.S. Pat. No. 4,320,019 which is expressly incorporated herein by reference for relevant teachings in this regard.

It must be noted that as used in this specification and appended claims, the singular forms also include the plural unless the context clearly dictates otherwise. Thus the singular forms "a", "an", and "the" include the plural; for example "an amine" includes mixtures of amines of the same type. As another example the singular form "amine" is intended to include both singular and plural unless the context clearly indicates otherwise.

The term "Total Base Number" or "TBN" as used herein refers to the amount of base equivalent to milligrams of KOH in 1 gram of sample. Thus, higher TBN numbers reflect more alkaline products, and therefore a greater alkalinity reserve. The TBN of a sample can be determined by ASTM Test No. D2896-11 issued May 15, 2011 or any other equivalent procedure.

In one aspect the present disclosure provides a lubricating oil composition which comprises (a) a major amount of an oil of lubricating viscosity; (b) an oil soluble or oil dispersible borated hydrocarbyl succinimide dispersant, wherein the hydrocarbyl or hydrocarbylene group has a number average molecular weight of from about 550 to about 1150; and (c) an oil soluble or oil dispersible tertiary hydrocarbylamine compound. In one embodiment, the hydrocarbyl succinimide dispersant is a polyisobutylene succinimide dispersant.

In another aspect the present disclosure provides a lubricating oil composition which comprises (a) a major amount of an oil of lubricating viscosity; (b) an oil soluble or oil dispersible borated hydrocarbyl succinimide dispersant, wherein the hydrocarbyl group has a number average molecular weight of greater than 1150 to about 5000; and (c) an oil soluble or oil dispersible tertiary hydrocarbylamine compound, wherein the boron content of the lubricating oil composition is less than about 470 ppm. In one embodiment, the hydrocarbyl succinimide dispersant is a polyisobutylene succinimide dispersant.

Oil of Lubricating Viscosity

The neutral oil may be selected from Group I base stock, Group II base stock, Group III base stock, Group IV or poly-alpha-olefins (PAO), Group V, or base oil blends thereof. The base stock or base stock blend preferably has a saturate content of at least 65%, more preferably at least 75%; a sulfur content of less than 1%, preferably less than 0.6%, by weight; and a viscosity index of at least 85, preferably at least 100. These base stocks can be defined as follows:

Group I: base stocks containing less than 90% saturates and/or greater than 0.03% sulfur and having a viscosity index greater than or equal to 80 and less than 120 using test methods specified in Table 1 of the American Petroleum Institute (API) publication "Engine Oil Licensing and Certification Sheet" Industry Services Department, 14th Ed., December 1996, Addendum I, December 1998;

Group II: base stocks containing greater than or equal to 90% saturates and/or greater than 0.03% sulfur and having a viscosity index greater than or equal to 80 and less than 120 using test methods specified in Table 1 referenced above;

Group III: base stocks which are less than or equal to 0.03% sulfur, greater than or equal to 90% saturates, and greater than or equal to 120 using test methods specified in Table 1 referenced above.

Group IV: base stocks which comprise PAO's.

Group V: base stocks include all other base stocks not included in Group I, II, III, or IV.

For these definitions, saturates level can be determined by ASTM D 2007, the viscosity index can be determined by ASTM D 2270; and sulfur content by any one of ASTM D 2622, ASTM D 4294, ASTM D 4927, or ASTM D 3120.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C). Generally, individually the base oils used as engine oils will have a kinematic viscosity range at 100° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-16, 0W-20, 0W-26, 0W-30, 0W-40, 0W-50, 0W-60, 5W, 5W-20, 5W-30, 5W-40, 5W-50, 5W-60, 10W, 10W-20, 10W-30, 10W-40, 10W-50, 10W-60, 15W, 15W-20, 15W-30, 15W-40, 15W-50 or 15W-60. Oils used as gear oils can have viscosities ranging from about 2 cSt to about 2000 cSt at 100° C.

Borated Dispersant

Examples of borated ashless dispersants are the borated ashless hydrocarbyl succinimide dispersants prepared by reacting a hydrocarbyl succinic acid or anhydride with an amine. Preferred hydrocarbyl succinic acids or anhydrides are those where the hydrocarbyl group is derived from a polymer of a $C_3$ or $C_4$ monoolefin, especially a polyisobutylene wherein the polyisobutenyl group has a number average molecular weight (Mn) of from 700 to 5,000, more preferably from 900 to 2,500. Such dispersants generally have at least 1, preferably 1 to 2, more preferably 1.1 to 1.8, succinic groups for each polyisobutenyl group. In one embodiment, the oil soluble or oil dispersible borated polyisobutylene succinimide dispersant, is derived from a polyisobutylene group having a number average molecular weight of from about 550 to about 1150. In one embodiment, the oil soluble or oil dispersible borated polyisobutylene succinimide dispersant, is derived from a polyisobutylene group having a number average molecular weight of about 1000. In one embodiment, the oil soluble or oil dispersible borated polyisobutylene succinimide dispersant is derived from a polyisobutylene group having a number average molecular weight of greater than 1150 to about 5000. In one embodiment, the oil soluble or oil dispersible borated polyisobutylene succinimide dispersant is derived from a polyisobutylene group having a number average molecular weight of about 1300.

Preferred amines for reaction to form the succinimide are polyamines having from 2 to 60 carbon atoms and from 2 to 12 nitrogen atoms per molecule, and particularly preferred are the polyalkyleneamines represented by the formula (1):

$$NH_2(CH_2)_n—(NH(CH_2)_n)_m—NH_2 \quad \text{Formula (1)}$$

wherein n is 2 to 3 and m is 0 to 10. Illustrative are ethylene diamine, diethylene triamine, triethylene tetramine, tetraethylene pentamine, tetrapropylene pentamine, pentaethylene hexamine and the like, as well as the commercially available mixtures of such polyamines. Amines including other groups such as hydroxy, alkoxy, amide, nitride and imidazoline groups may also be used, as may polyoxyalkylene polyamines. The amines are reacted with the alkenyl succinic acid or anhydride in conventional ratios of about 1:1 to 10:1, preferably 1:1 to 3:1, moles of alkenyl succinic acid or anhydride to polyamine, and preferably in a ratio of about 1:1, typically by heating the reactants to from 100° to 250° C., preferably 125° to 175° C. for 1 to 10, preferably 2 to 6, hours.

The boration of alkenyl succinimide dispersants is also well known in the art as disclosed in U.S. Pat. Nos. 3,087,936 and 3,254,025. The succinimide may for example be treated with a boron compound selected from the group consisting of boron, boron oxides, boron halides, boron acids and esters thereof, in an amount to provide from 0.1 atomic proportion of boron to 10 atomic proportions of boron for each atomic proportion of nitrogen in the dispersant.

The borated product will generally contain 0.1 to 2.0, preferably 0.2 to 0.8 weight percent boron based upon the total weight of the borated dispersant. Boron is considered to be present as dehydrated boric acid polymers attaching at the metaborate salt of the imide. The boration reaction is readily carried out adding from 1 to 3 weight percent (based on the weight of dispersant) of said boron compound, preferably boric acid, to the dispersant as a slurry in mineral oil and heating with stirring from 135° C. to 165° C. for 1 to 5 hours followed by nitrogen stripping filtration of the product. Alternatively boric acid may be added to the hot reaction mixture of succinic acid or anhydride and amine while removing water.

In one embodiment, the borated dispersant supplies at least 50 ppm of boron to the lubricating oil composition, at least 100 ppm, at least 150 ppm, at least 200 ppm, at least 250 ppm, at least 300 ppm of boron to the lubricating oil composition. In one embodiment, the borated dispersant supplies from 50 to 600 ppm boron to the lubricating oil composition. In one embodiment, the borated dispersant supplies from 50 to 350 ppm boron to the lubricating oil composition. In one embodiment, the borated dispersant supplies from 50 to 300 ppm boron to the lubricating oil composition.

Tertiary Hydrocarbyl Amine Compounds

The tertiary amine compounds are useful for increasing the TBN of lubricating oil compositions without introducing sulfated ash.

Thus, in an aspect the tertiary hydrocarbylamine is a compound having the following formula (2):

$$R^8R^9R^{10}N \quad \text{(Formula 2),}$$

wherein $R^8$, $R^9$, and $R^{10}$ are the same or different and each individually are selected from the group consisting of straight-chain or branched, saturated or unsaturated hydrocarbyl group.

In one embodiment, at least one of $R^8$, $R^9$, and $R^{10}$ is a $C_8$-$C_{40}$ hydrocarbyl group. In another embodiment, at least one of $R^8$, $R^9$, and $R^{10}$ is a $C_8$-$C_{20}$ hydrocarbyl group. In yet another embodiment, at least one of $R^8$, $R^9$, and $R^{10}$ is a $C_{12}$-$C_{20}$ hydrocarbyl group.

In one embodiment, at least one of $R^8$, $R^9$, and $R^{10}$ is a $C_8$-$C_{40}$ straight-chain hydrocarbyl group. In another embodiment, at least one of $R^8$, $R^9$, and $R^{10}$ is a $C_8$-$C_{20}$ straight-chain hydrocarbyl group. In yet another embodiment, at least one of $R^8$, $R^9$, and $R^{10}$ is a $C_{12}$-$C_{20}$ straight-chain hydrocarbyl group.

In one embodiment, at least one of $R^8$, $R^9$, and $R^{10}$ is a $C_8$-$C_{40}$ branched hydrocarbyl group. In another embodiment, at least one of $R^8$, $R^9$, and $R^{10}$ is a $C_8$-$C_{20}$ branched hydrocarbyl group. In yet another embodiment, at least one of $R^8$, $R^9$, and $R^{10}$ is a $C_{12}$-$C_{20}$ branched hydrocarbyl group.

In one embodiment, at least one of $R^8$, $R^9$, and $R^{10}$ is a saturated $C_8$-$C_{40}$ hydrocarbyl group. In another embodiment, at least one of $R^8$, $R^9$, and $R^{10}$ is a saturated $C_8$-$C_{20}$ hydrocarbyl group. In yet another embodiment, at least one of $R^8$, $R^9$, and $R^{10}$ is a saturated $C_{12}$-$C_{20}$ hydrocarbyl group.

In one embodiment, at least one of $R^8$, $R^9$, and $R^{10}$ is an unsaturated $C_8$-$C_{40}$ hydrocarbyl group. In another embodiment, at least one of $R^8$, $R^9$, and $R^{10}$ is an unsaturated $C_8$-$C_{20}$ hydrocarbyl group. In yet another embodiment, at least one of $R^8$, $R^9$, and $R^{10}$ is an unsaturated $C_{12}$-$C_{20}$ hydrocarbyl group.

In one embodiment, at least one of $R^8$, $R^9$, and $R^{10}$ is a saturated $C_8$-$C_{40}$ straight-chain hydrocarbyl group. In another embodiment, at least one of $R^8$, $R^9$, and $R^{10}$ is a saturated $C_8$-$C_{20}$ straight-chain hydrocarbyl group. In yet another embodiment, at least one of $R^8$, $R^9$, and $R^{10}$ is a saturated $C_{12}$-$C_{20}$ straight-chain hydrocarbyl group.

In one embodiment, at least one of $R^8$, $R^9$, and $R^{10}$ is an unsaturated $C_8$-$C_{40}$ straight-chain hydrocarbyl group. In another embodiment, at least one of $R^8$, $R^9$, and $R^{10}$ is an unsaturated $C_8$-$C_{20}$ straight-chain hydrocarbyl group. In yet another embodiment, at least one of $R^8$, $R^9$, and $R^{10}$ is an unsaturated $C_{12}$-$C_{20}$ straight-chain hydrocarbyl group.

In one embodiment, at least one of $R^8$, $R^9$, and $R^{10}$ is a saturated $C_8$-$C_{40}$ branched hydrocarbyl group. In another embodiment, at least one of $R^8$, $R^9$, and $R^{10}$ is a saturated $C_8$-$C_{20}$ branched hydrocarbyl group. In yet another embodiment, at least one of $R^8$, $R^9$, and $R^{10}$ is a saturated $C_{12}$-$C_{20}$ branched hydrocarbyl group.

In one embodiment, at least one of $R^8$, $R^9$, and $R^{10}$ is an unsaturated $C_8$-$C_{40}$ branched hydrocarbyl group. In another embodiment, at least one of $R^8$, $R^9$, and $R^{10}$ is an unsaturated $C_8$-$C_{20}$ branched hydrocarbyl group. In yet another embodiment, at least one of $R^8$, $R^9$, and $R^{10}$ is an unsaturated $C_{12}$-$C_{20}$ branched hydrocarbyl group.

In one embodiment, at least two of $R^8$, $R^9$, and $R^{10}$ is a $C_8$-$C_{40}$ hydrocarbyl group. In another embodiment, at least two of $R^8$, $R^9$, and $R^{10}$ is a $C_8$-$C_{20}$ hydrocarbyl group. In yet another embodiment, at least two of $R^8$, $R^9$, and $R^{10}$ is a $C_{12}$-$C_{20}$ hydrocarbyl group.

In one embodiment, at least two of $R^8$, $R^9$, and $R^{10}$ is a $C_8$-$C_{40}$ straight-chain hydrocarbyl group. In another embodiment, at least two of $R^8$, $R^9$, and $R^{10}$ is a $C_8$-$C_{20}$ straight-chain hydrocarbyl group. In yet another embodiment, at least two of $R^8$, $R^9$, and $R^{10}$ is a $C_{12}$-$C_{20}$ straight-chain hydrocarbyl group.

In one embodiment, at least two of $R^8$, $R^9$, and $R^{10}$ is a $C_8$-$C_{40}$ branched hydrocarbyl group. In another embodiment, at least two of $R^8$, $R^9$, and $R^{10}$ is a $C_8$-$C_{20}$ branched hydrocarbyl group. In yet another embodiment, at least two of $R^8$, $R^9$, and $R^{10}$ is a $C_{12}$-$C_{20}$ branched hydrocarbyl group.

In one embodiment, at least two of $R^8$, $R^9$, and $R^{10}$ is a saturated $C_8$-$C_{40}$ hydrocarbyl group. In another embodiment, at least two of $R^8$, $R^9$, and $R^{10}$ is a saturated $C_8$-$C_{20}$ hydrocarbyl group. In yet another embodiment, at least two of $R^8$, $R^9$, and $R^{10}$ is a saturated $C_{12}$-$C_{20}$ hydrocarbyl group.

In one embodiment, at least two of $R^8$, $R^9$, and $R^{10}$ is an unsaturated $C_8$-$C_{40}$ hydrocarbyl group. In another embodiment, at least two of $R^8$, $R^9$, and $R^{10}$ is an unsaturated $C_8$-$C_{20}$ hydrocarbyl group. In yet another embodiment, at least two of $R^8$, $R^9$, and $R^{10}$ is an unsaturated $C_{12}$-$C_{20}$ hydrocarbyl group.

In one embodiment, at least two of $R^8$, $R^9$, and $R^{10}$ is a saturated $C_8$-$C_{40}$ straight-chain hydrocarbyl group. In another embodiment, at least two of $R^8$, $R^9$, and $R^{10}$ is a saturated $C_8$-$C_{20}$ straight-chain hydrocarbyl group. In yet another embodiment, at least two of $R^8$, $R^9$, and $R^{10}$ is a saturated $C_{12}$-$C_{20}$ straight-chain hydrocarbyl group.

In one embodiment, at least two of $R^8$, $R^9$, and $R^{10}$ is an unsaturated $C_8$-$C_{40}$ straight-chain hydrocarbyl group. In another embodiment, at least two of $R^8$, $R^9$, and $R^{10}$ is an unsaturated $C_8$-$C_{20}$ straight-chain hydrocarbyl group. In yet another embodiment, at least two of $R^8$, $R^9$, and $R^{10}$ is an unsaturated $C_{12}$-$C_{20}$ straight-chain hydrocarbyl group.

In one embodiment, at least two of $R^8$, $R^9$, and $R^{10}$ is a saturated $C_8$-$C_{40}$ branched hydrocarbyl group. In another embodiment, at least two of $R^8$, $R^9$, and $R^{10}$ is a saturated $C_8$-$C_{20}$ branched hydrocarbyl group. In yet another embodiment, at least two of $R^8$, $R^9$, and $R^{10}$ is a saturated $C_{12}$-$C_{20}$ branched hydrocarbyl group.

In one embodiment, at least two of $R^8$, $R^9$, and $R^{10}$ is an unsaturated $C_8$-$C_{40}$ branched hydrocarbyl group. In another embodiment, at least two of $R^8$, $R^9$, and $R^{10}$ is an unsaturated $C_8$-$C_{20}$ branched hydrocarbyl group. In yet another embodiment, at least two of $R^8$, $R^9$, and $R^{10}$ is an unsaturated $C_{12}$-$C_{20}$ branched hydrocarbyl group.

In one embodiment, at least one of $R^8$, $R^9$, and $R^{10}$ is a $C_1$-$C_6$ hydrocarbyl group. Non-limiting examples include methyl, ethyl, propyl, isopropyl, butyl, sec-butyl, tert-butyl, isobutyl, pentyl, hexyl group.

In one embodiment, at least one of $R^8$, $R^9$, and $R^{10}$ is derived from a fatty acid source. In another embodiment, at least two of $R^8$, $R^9$, and $R^{10}$ is derived from a fatty acid source. The fatty acid source can be for example, but not limited to, tallow oil, lard oil, palm oil, castor oil, cottonseed oil, corn oil, peanut oil, soybean oil, sunflower oil, olive oil, whale oil, menhaden oil, sardine oil, coconut oil, palm kernel oil, babassu oil, rape oil, soya oil or mixtures thereof.

In one embodiment, the tertiary amine can be sterically hindered. The sterically hindered amine compound of general formula, (5) is acyclic. The term "acyclic" is intended to mean that the sterically hindered amine compound of general formula (5) is free from any cyclic structures and aromatic structures. The sterically hindered amine compound of general formula (5) can be exemplified by: N-tert-butyl-2-ethyl-N-methyl-hexan-1-amine, tert-amyl-tert-butylamine, N-tert-butylheptan-2-amine.

In one embodiment, the tertiary amine has 1 nitrogen atom. In one embodiment, the tertiary amine has 2 nitrogen atoms. In one embodiment, the tertiary amine has 3 nitrogen atoms. In one embodiment, the tertiary amine has 4 nitrogen atoms.

Alternatively, the tertiary amine compound may be a monomeric cyclic amine compound.

The sterically hindered amine compound may have a weight average molecular weight of from 100 to 1200. Alternatively, the sterically hindered amine compound may have a weight average molecular weight of from 200 to 800, or 200 to 600. Alternatively still, the sterically hindered amine compound may have a weight average molecular weight of less than 500.

As used herein, the term "sterically hindered amine compound" means an organic molecule having fewer than two hydrogen atoms bonded to at least one alpha-carbon with reference to a secondary or tertiary nitrogen atom. In other embodiments, the term "sterically hindered amine compound" means an organic molecule having no hydrogen atoms bonded to at least one alpha-carbon with reference to a secondary or tertiary nitrogen atom. In still other embodiments, the term "sterically hindered amine compound" means an organic molecule having no hydrogen atoms bonded to each of at least two alpha-carbons with reference to a secondary or tertiarynitrogen atom.

In one embodiment, the tertiary amine compound is a hindered tertiary amine compound.

In one embodiment, the tertiary amine is an alkyl di-alkanolamine. Such alkyl di-alkanolamines include, but are not limited to, di-ethanolamines derived from coconut oil. Typically, the alkyl group in coconut oil comprises mixtures of caprylyl, capryl, lauryl, myristyl, palmityl stearyl, oleyl and linoleyl.

In one embodiment, the tertiary amine is an alkyl di-alkanolamine having the following formula (3):

(Formula 3)

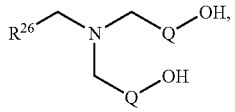

where $R^{26}$ has from 1 to 30 carbon atoms; preferably wherein $R^{26}$ has from 6 to 22 carbon atoms; more preferably, where $R^{26}$ has from about 8 to about 18 carbon atoms and where Q is a $C_1$ to $C_4$ linear or branched alkylene group. In one embodiment, $R^{26}$ has 17 carbon atoms. In another embodiment, $R^{26}$ has 11 carbon atoms.

In one embodiment, the di-alkanolamine comprises a bis-ethoxy alkylamine. For example, the bis-ethoxy alkylamine has the following formula (4):

(Formula 4)

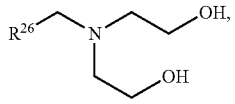

where $R^{26}$ comprises 1 to 30 carbon atoms; preferably where $R^{26}$ comprises 6 to 22 carbon atoms; more preferably, where $R^{26}$ comprises from about 8 to about 18 carbon atoms. In one embodiment, $R^{26}$ has 17 carbon atoms. In another embodiment, $R^{26}$ has 11 carbon atoms.

The alkyl group of the di-alkanolamine can have varying levels of unsaturation. For example, the alkyl group can comprise double and triple bonds.

Typically, alkyl di-alkanolamines are commercially available from Akzo Nobel. For example, products sold under the tradename Ethomeen® C/12, Propomeen® T12, or Ethomeen® O/12 are suitable di-alkanolamines for use in the present disclosure.

Examples of alkyl alkanolamines include but are not limited to the following: Oleyl diethanolamine, dodecyl diethanolamine, 2-ethylhexyl diethanolamine, diethanolamine derived from coconut oil and diethanolamine derived from beef tallow and the like.

The tertiary amine may be prepared by methods that are well known in the art. Alkyl di-alkanolamines may be prepared according to U.S. Pat. Nos. 4,085,126; 7,479,473 and other methods that are well known in the art; or, they may be purchased from Akzo Nobel.

Other suitable amines suitable for use in the present disclosure are described in U.S. Pat. No. 9,145,530, US 20130252865, US 20140051621, US 20140106996 the disclosures of which is incorporated herein by reference.

In some embodiments, the tertiary amine does not contain an aromatic group. In some embodiments, the s tertiary amine has one aromatic group and the other substituents (i.e., 1 or 2 depending on amine) are branched alkyl groups.

The tertiary amine compounds may have a weight average molecular weight of from 100 to 1200, 200 to 800, or 200 to 600. Alternatively, the monomeric cyclic amine compound may have a weight average molecular weight of less than 500, or at least 50. In some embodiments, the monomeric cyclic amine compound is free from aromatic groups, such as phenyl and benzyl rings. In other embodiments, the monomeric cyclic amine compound is aliphatic.

The monomeric cyclic amine compound may include two or fewer nitrogen atoms per molecule. Alternatively, the monomeric cyclic amine compound may include only one nitrogen per molecule. The phrase "nitrogen per molecule" refers to the total number of nitrogen atoms in the entire molecule, including the body of the molecule and any substituent groups. In certain embodiments, the monomeric cyclic amine compound includes one or two nitrogen atoms in the cyclic ring of the monomeric cyclic amine compound.

Non-limiting examples of tertiary amines are: N, N-dimethyl-N-(2-ethylhexyl)amine, N, N-dimethyl-N-(2-propylheptyl)amine, dodecyldimethylamine (Armeen®DM12D), octadecyldimethylamine (Armeen®DM18D), hexadecyldimethylamine, oleyldimethylamine(Armeen®DMOD), cocoyldimethylamine (Armeen®DMCD), hydrogenated talloalkyldimethylamines (Armeen®DMHTD), dicocoylmethylamine (Armeen®M2C), tallowdimethylamine, ditallowmethylamine (Armeen®M2HT), tridodecylamine (Armeen®312), trihexadecylamine (ARMEEN®316), trioctadecylamine, soyadimethylamine (Armeen®DMSD), tris (2-ethylhexyl)amine, 2-Ethylhexyl(tallow)methylamine (Armeen®MHTL8), dodecyldimetylamine (Armeen®DM12D), octadecyldimethylamine (Armeen®DM18D), Cocoalkyldimetylamine (Armeen®DMCD), Hydrogenated Tallowalkyldimethylamines (Armeen®DMHTD), Oleylalkyldimethylamine (Armeen®DMOD), Soyaalkyldimethylamines (Armeen®DMSD), and Alamine 336 (tri-n-octylamine).

In certain embodiments, the tertiary hydrocarbylamine compound has a TBN value of at least 20 mg KOH/g when tested according to ASTM D2896, a TBN value of at least 30 mg KOH/g when tested according to ASTM D2896, a TBN value of at least 40 mg KOH/g when tested according to ASTM D2896, a TBN value of at least 60 mg KOH/g when tested according to ASTM D2896, a TBN value of at least 80 mg KOH/g when tested according to ASTM D2896. Alternatively, the amine compound has a TBN value of at least 90, at least 100, at least 110, at least 120, at least 130, at least 140, at least 150, or at least 160, mg KOH/g, when tested according to ASTM D2896. Alternatively still, the amine compound may have a TBN value of from 20 to 500, 60 to 300, 80 to 200, 90 to 190, 100 to 180, or 100 to 150, mg KOH g, when tested according to ASTM D2896.

In some embodiments, the tertiary hydrocarbylamine compound does not negatively affect the total base number of the lubricant composition. Alternatively, the tertiary hydrocarbylamine compound may improve the TBN of the lubricant composition by, at least 0.5, at least 0.6, at least 0.7 at least 0.8, at least 0.9, at least 1.0, at least 1.5, at least 2, at least 2.5, at least 3, at least 3.5, at least 4, at least 4.5, at least 5 at least 10, or at least 15, mg KOH/g. The TBN value of the lubricant composition can be determined according to ASTM D2896.

If the tertiary hydrocarbylamine compound is included in the additive package, the additive package includes the amine compound in an amount of from 0.1 to 50 wt. %, based on the total weight of the additive package. Alternatively, the additive package may include the tertiary hydrocarbylamine compound in an amount of from 1 to 25, 0.1 to 15, 1 to 10, 0.1 to 8, or 1 to 5, wt. %, based on the total weight of the additive package.

The lubricating oil composition includes the tertiary hydrocarbylamine compound in an amount of from 0.1 to 25, 0.1 to 20, 0.1 to 15, or 0.1 to 10, wt. %, based on the total weight of the lubricant composition. Alternatively, the lubricant composition may include the tertiary hydrocarbylamine compound in an amount of from 0.5 to 5, 1 to 3, or 1 to 2, wt. %, based on the total weight of the lubricant composition. In another embodiment, the lubricating oil composition may include the tertiary hydrocarbylamine compound in an amount of from greater than 0.1, greater than 0.2, greater than 0.25, greater than 0.3, greater than 0.35, greater than 0.4, greater than 0.45, greater than 0.5 wt. %, based on the total weight of the lubricating oil composition. Combinations of various tertiary hydrocarbylamine compounds are also contemplated.

Other Boron-Containing Additives

In addition to the borated dispersants described herein, representative examples of at least one oil-soluble or dispersed oil-stable boron-containing compound for use in the lubricating oil compositions of the present disclosure include a borated friction modifier; a dispersed alkali metal or a mixed alkali metal or an alkaline earth metal borate, a borated epoxide, a borate ester, a borated fatty amine, a borated amide, a borated detergent (i.e., sulfonate, salicylate) and the like, and mixtures thereof.

Examples of borated friction modifiers include, but are not limited to, borated fatty epoxides, borated alkoxylated fatty amines, borated glycerol esters and the like and mixtures thereof. Additionally, borated amides as described in U.S. Pat. No. 9,227,920 are also contemplated and are incorporated herein by reference.

The hydrated particulate alkali metal borates are well known in the art and are available commercially. Representative examples of hydrated particulate alkali metal borates and methods of manufacture include those disclosed in, e.g., U.S. Pat. Nos. 3,313,727; 3,819,521; 3,853,772; 3,907,601; 3,997,454; 4,089,790; 6,737,387 and 6,534,450, the contents of which are incorporated herein by reference. The hydrated alkali metal borates can be represented by the following Formula (5):

$$M_2O.mB_2O_3.nH_2O \qquad \text{Formula (5)}$$

where M is an alkali metal of atomic number in the range of about 11 to about 19, e.g., sodium and potassium; in is a number from about 2.5 to about 4.5 (both whole and fractional); and n is a number from about 1.0 to about 4.8. Preferred are the hydrated sodium borates. The hydrated borate particles generally have a mean particle size of less than about 1 micron.

Examples of borated epoxides include borated epoxides obtained from the reaction product of one or more of the boron compounds with at least one epoxide. Suitable boron compounds include boron oxide, boron oxide hydrate, boron trioxide, boron trifluoride, boron tribromide, boron trichloride, boron acids such as boronic acid, boric acid, tetraboric acid and metaboric acid, boron amides and various esters of boron acids. The epoxide is generally an aliphatic epoxide having from about 8 to about 30 carbon atoms and preferably from about 10 to about 24 carbon atoms and more preferably from about 12 to about 20 carbon atoms. Suitable aliphatic epoxides include dodecene oxide, hexadecene oxide and the like and mixtures thereof. Mixtures of epoxides may also be used, for instance commercial mixtures of epoxides having from about 14 to about 16 carbon atoms or from about 14 to about 18 carbon atoms. The borated epoxides are generally known and described in, for example, U.S. Pat. No. 4,584,115.

Examples of borate esters include those borate esters obtained by reacting one or more of the boron compounds disclosed above with one or more alcohols of suitable oleophilicity. Typically, the alcohols will contain from 6 to about 30 carbons and preferably from 8 to about 24 carbon atoms. The methods of making such borate esters are well known in the art. The borate esters can also be borated phospholipids. Representative examples of borate esters include those having the structures set forth in Formulae (6-8):

Formula 6

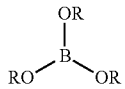

Formula 7

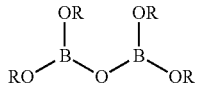

Formula 8

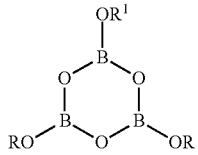

wherein each R is independently a $C_1$-$C_{12}$ straight or branched alkyl group and $R^1$ is hydrogen or a $C_1$-$C_{12}$ straight or branched alkyl group.

Examples of borated fatty amines include borated fatty amines obtained by reacting one or more of the boron compounds disclosed above with one or more of fatty amines, e.g., an amine having from about fourteen to about eighteen carbon atoms. The borated fatty amines may be prepared by reacting the amine with the boron compound at a temperature in the range of from about 50 to about 300° C., and preferably from about 100 to about 250° C., and at a ratio from about 3:1 to about 1:3 equivalents of amine to equivalents of boron compound.

Examples of borated amides include borated amides obtained from the reaction product of a linear or branched, saturated or unsaturated monovalent aliphatic acid having 8 to about 22 carbon atoms, urea, and polyalkylenepolyamine with a boric acid compound and the like and mixtures thereof.

Examples of borated sulfonates include borated alkaline earth metal sulfonates obtained by (a) reacting in the presence of a hydrocarbon solvent (i) at least one of an oil-soluble sulfonic acid or alkaline earth sulfonate salt or mixtures thereof, (ii) at least one source of an alkaline earth metal; (iii) at least one source of boron, and (iv) from 0 to less than 10 mole percent, relative to the source of boron, of an overbasing acid, other than the source of boron; and (b) heating the reaction product of (a) to a temperature above the distillation temperature of the hydrocarbon solvent to distill the hydrocarbon solvent and water from the reaction. Suitable borated alkaline earth metal sulfonates include those disclosed in, for example, U.S. Patent Application Publication No. 20070123437, the contents of which are incorporated by reference herein.

When the lubricating oil composition contains an oil soluble or oil dispersible borated hydrocarbyl succinimide dispersant where the hydrocarbyl group has a number average molecular weight of from about 550 to about 1150, the lubricating oil compositions of the present disclosure will contain no more than about 800 ppm of boron, based upon the total mass of the composition, provided from the one or more oil-soluble or dispersed oil-stable boron-containing compounds as described herein. In one embodiment, the lubricating oil compositions of the present invention will contain no more than about 700 ppm, no more than about 600 ppm, no more than about 500 ppm of boron, based upon the total mass of the composition, provided from the one or more oil-soluble or dispersed oil-stable boron-containing compounds as described herein.

When the lubricating oil composition contains an oil soluble or oil dispersible borated hydrocarbyl succinimide dispersant where the hydrocarbyl group has a number average molecular weight of greater than 1150 to about 5000, the lubricating oil compositions of the present invention will contain no more than about 470 ppm of boron, based upon the total mass of the composition, provided from the one or more oil-soluble or dispersed oil-stable boron-containing compounds. In one embodiment, the lubricating oil compositions of the present invention will contain no more than about 450 ppm, or no more than about 400 ppm, based upon the total mass of the composition, provided from the one or more oil-soluble or dispersed oil-stable boron-containing compounds as described herein.

In another aspect, the present disclosure provides a method for increasing fresh oil TBN of a lubricating oil composition while at the same time improving corrosion resistance in an internal combustion engine operated with a lubricating oil described herein.

Further, in an aspect the present disclosure provides a method for reducing copper corrosion comprising the lubricating oil described herein.

Additional Lubricating Oil Additives

The lubricating oil compositions of the present disclosure may also contain other conventional additives that can impart or improve any desirable property of the lubricating oil composition in which these additives are dispersed or dissolved. Any additive known to a person of ordinary skill in the art may be used in the lubricating oil compositions disclosed herein. Some suitable additives have been described in Mortier et al., "Chemistry and Technology of Lubricants", 2nd Edition, London, Springer, (1996); and Leslie R. Rudnick, "Lubricant Additives: Chemistry and Applications", New York, Marcel Dekker (2003), both of which are incorporated herein by reference. For example, the lubricating oil compositions can be blended with antioxidants, anti-wear agents, detergents such as metal detergents, rust inhibitors, dehazing agents, demulsifying agents, metal deactivating agents, friction modifiers, pour point depressants, antifoaming agents, co-solvents, corrosion-inhibitors, ashless dispersants, multifunctional agents, dyes, extreme pressure agents and the like and mixtures thereof. A variety of the additives are known and commercially available. These additives, or their analogous compounds, can be employed for the preparation of the lubricating oil compositions of the disclosure by the usual blending procedures.

In the preparation of lubricating oil formulations, it is common practice to introduce the additives in the form of 10 to 80 wt. % active ingredient concentrates in hydrocarbon oil, e.g. mineral lubricating oil, or other suitable solvent.

Usually these concentrates may be diluted with 3 to 100, e.g., 5 to 40, parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant.

In general, the concentration of each of the additives in the lubricating oil composition, when used, may range from about 0.001 wt. % to about 20 wt. %, from about 0.01 wt. % to about 15 wt. %, or from about 0.1 wt. % to about 10 wt. %, from about 0.005 wt. % to about 5 wt. %, or from about 0.1 wt. % to about 2.5 wt. %, based on the total weight of the lubricating oil composition. Further, the total amount of the additives in the lubricating oil composition may range from about 0.001 wt. % to about 20 wt. %, from about 0.01 wt. % to about 10 wt. %, or from about 0.1 wt. % to about 5 wt. %, based on the total weight of the lubricating oil composition.

The following examples are presented to exemplify embodiments of the disclosure but are not intended to limit the disclosure to the specific embodiments set forth. Unless indicated to the contrary, all parts and percentages are by weight. All numerical values are approximate. When numerical ranges are given, it should be understood that embodiments outside the stated ranges may still fall within the scope of the disclosure. Specific details described in each example should not be construed as necessary features of the disclosure.

It will be understood that various modifications may be made to the embodiments disclosed herein. Therefore the above description should not be construed as limiting, but merely as exemplifications of preferred embodiments. For example, the functions described above and implemented as the best mode for operating the present disclosure are for illustration purposes only. Other arrangements and methods may be implemented by those skilled in the art without departing from the scope and spirit of this disclosure. Moreover, those skilled in the art will envision other modifications within the scope and spirit of the claims appended hereto.

EXAMPLES

The following examples are intended for illustrative purposes only and do not limit in any way the scope of the present disclosure.

Lubricating Oil Baseline Formulation

A lubricating oil composition was prepared by blending together the following components to obtain an SAE 5W-30 viscosity grade formulation:

(a) secondary zinc diaklyldithiophosphate;
(b) magnesium sulfonate detergent;
(c) a borated sulfonate detergent;
(d) a molybdenum-succinimide complex;
(e) ethylene carbonate treated succinimide dispersant and terpolymer dispersant;
(f) calcium phenate and calcium sulfonates;
(g) an alkylated diphenylamine and hindered phenol antioxidant;
(h) dispersant OCP;
(i) metal free friction modifier
(j) conventional amounts of pour point depressant, viscosity index improver, and foam inhibitor; and
(k) the balance a mixture of Group III base oils.

Example 1

The formulation baseline was duplicated except the presence of 0.25 wt. % of Armeen® MHTL8 (2-Ethylhexyl, hydrogenated tallowalkylmethylamines, Akzo Nobel, total amine value 141 mg KOH/g) and 1.98 wt. % actives of a boron post-treated succinimide dispersant derived from ~1000 MW PIBSA and heavy polyamine. The lubricating oil composition had a total 380 ppm of boron from the borated sulfonate, organic friction modifier, and borated dispersant.

Example 2

The formulation baseline was duplicated except the presence of 0.30 wt. % of Armeen® MHTL8 (2-Ethylhexyl, hydrogenated tallowalkylmethylamines, Akzo Nobel, total amine value 141 mg KOH/g) and 1.98 wt. % actives of a boron post-treated succinimide dispersant derived from ~1000 MW PIBSA and heavy polyamine. The lubricating oil composition had a total 490 ppm of boron from the borated sulfonate, organic friction modifier, and borated dispersant.

Example 3

The formulation baseline was duplicated except the presence of 0.25 wt. % of Propomeen® T12 (N-tallowalkyl-1, 1'-iminobis-2-propanol, Akzo Nobel, CAS 68951-72-4, total amine value 145-152 mg KOH/g) and 1.98 wt. % actives of a boron post-treated succinimide dispersant derived from ~1000 MW PIBSA and heavy polyamine. The lubricating oil composition had a total 380 ppm of boron from the borated sulfonate, organic friction modifier, and borated dispersant.

Example 4

The formulation baseline was duplicated except the presence of 0.30 wt. % of Propomeen® T12 (N-tallowalkyl-1, 1'-iminobis-2-propanol, Akzo Nobel, CAS 68951-72-4, total amine value 145-152 mg KOH/g) and 1.98 wt. % actives of a boron post-treated succinimide dispersant derived from ~1000 MW PIBSA and heavy polyamine. The lubricating oil composition had a total 490 ppm of boron from the borated sulfonate, organic friction modifier, and borated dispersant.

Example 5

The formulation baseline was duplicated except the presence of 0.40 wt. % of Armeen® M2HT (N-methyl-N,N-ditallowamine, Akzo Nobel, CAS 61788-63-4, total amine value 103-110 mg KOH/g) and 1.98 wt. % actives of a boron post-treated succinimide dispersant derived from ~1000 MW PIBSA and heavy polyamine. The lubricating oil composition had a total 490 ppm of boron from the borated sulfonate, organic friction modifier, and borated dispersant.

Example 6

The formulation baseline was duplicated except the presence of 0.33 wt. % of Armeen® M2HT (N-methyl-N,N-ditallowamine, Akzo Nobel, CAS 61788-63-4, total amine value 103-110 mg KOH/g) and 1.98 wt. % actives of a boron post-treated succinimide dispersant derived from ~1000 MW PIBSA and heavy polyamine. The lubricating oil composition had a total 380 ppm of boron from the borated sulfonate, organic friction modifier, and borated dispersant.

Comparative Example 1

The formulation baseline was duplicated except the presence of 2.4 wt. % actives of a boron post-treated succinimide dispersant derived from ~1000 MW PIBSA and heavy polyamine.

Comparative Example 2

The formulation baseline was duplicated except the presence of 0.25 wt. % of hindered secondary amine, SABO® STAB UV 91 (2,2,6,6-tetramethyl-4-piperidinyl esters (fatty acid mixture), SABO, CAS 61788-62-3, total amine value 128-137 mg KOH/g) and 1.98 wt. % actives of a boron post-treated succinimide dispersant derived from ~1000 MW PIBSA and heavy polyamine.

Comparative Example 3

The formulation baseline was duplicated except the presence of 1.98 wt. % actives of a boron post-treated succinimide dispersant derived from ~1000 MW PIBSA and heavy polyamine.

Comparative Example 4

The formulation baseline was duplicated except the presence of 0.30 wt. % of SABO® STAB UV 91 (2,2,6,6-tetramethyl-4-piperidinyl esters (fatty acid mixture), SABO, CAS 61788-62-3, total amine value 128-137 mg KOH/g) and 1.98 wt. % actives of a boron post-treated succinimide dispersant derived from ~1000 MW PIBSA and heavy polyamine.

Example 7

The formulation baseline was duplicated except the presence of 0.25 wt. % of Armeen® MHTL8 (2-Ethylhexyl, hydrogenated tallowalkylmethylamines, Akzo Nobel, total amine value 141 mg KOH/g) and 2.5 wt. % actives of a boron post-treated succinimide dispersant derived from ~1300 MW PIBSA and heavy polyamine. The lubricating oil composition had a total 440 ppm of boron from the borated sulfonate, organic friction modifier, and borated dispersant.

Example 8

The formulation baseline was duplicated except the presence of 0.25 wt. % of Propomeen® T12 (N-tallowalkyl-1,1'-iminobis-2-propanol, Akzo Nobel, CAS 68951-72-4, total amine value 145-152 mg KOH/g) and 2.5 wt. % actives of a boron post-treated succinimide dispersant derived from ~1300 MW PIBSA and heavy polyamine. The lubricating oil composition had a total 440 ppm of boron from the borated sulfonate, organic friction modifier, and borated dispersant.

Example 9

The formulation baseline was duplicated except the presence of 0.33 wt. % of Armeen® M2HT (N-methyl-N,N-ditallowamine, Akzo Nobel, CAS 61788-63-4, total amine value 103-110 mg KOH/g) and 2.5 wt. % actives of a boron post-treated succinimide dispersant derived from ~1300 MW PIBSA and heavy polyamine. The lubricating oil composition had a total 440 ppm of boron from the borated sulfonate, organic friction modifier, and borated dispersant.

Comparative Example 5

The formulation baseline was duplicated except the presence of 2.5 wt. % actives of a boron post-treated succinimide dispersant derived from ~1300 MW PIBSA and heavy polyamine. Additionally, in this example the borated organic friction modifier was omitted from the formulation. The lubricating oil composition had a total 470 ppm of boron from the borated sulfonate and borated dispersant.

Comparative Example 6

The formulation baseline was duplicated except the presence of 2.5 wt. % actives of a boron post-treated succinimide dispersant derived from ~1300 MW PIBSA and heavy polyamine. The lubricating oil composition had a total 500 ppm of boron from the borated sulfonate, organic friction modifier, and borated dispersant.

Comparative Example 7

The formulation baseline was duplicated except the presence of 2.5 wt. % actives of a boron post-treated succinimide dispersant derived from ~1300 MW PIBSA and heavy polyamine. The lubricating oil composition had a total 540 ppm of boron from the borated sulfonate, organic friction modifier, and borated dispersant.

Comparative Example 8

The formulation baseline was duplicated except the presence of 2.5 wt. % actives of a boron post-treated succinimide dispersant derived from ~1300 MW PIBSA and heavy polyamine. The lubricating oil composition had a total 580 ppm of boron from the borated sulfonate, organic friction modifier, and borated dispersant.

Comparative Example 9

The formulation baseline was duplicated except the presence of 2.5 wt. % actives of a boron post-treated succinimide dispersant derived from ~1300 MW PIBSA and heavy polyamine. The lubricating oil composition had a total 490 ppm of boron from the borated sulfonate, organic friction modifier, and borated dispersant.

Comparative Example 10

The formulation baseline was duplicated except the presence of 0.25 wt. % of hindered secondary amine, SABO® STAB UV 91 (2,2,6,6-tetramethyl-4-piperidinyl esters (fatty acid mixture), SABO, CAS 61788-62-3, total amine value 128-137 mg KOH/g) and 2.5 wt. % actives of a boron post-treated succinimide dispersant derived from ~1300 MW PIBSA and heavy polyamine. The lubricating oil composition had a total 440 ppm of boron from the borated sulfonate, organic friction modifier, and borated dispersant.

Comparative Example 11

The formulation baseline was duplicated except the presence of 0.30 wt. % of hindered secondary amine, SABO® STAB UV 91 (2,2,6,6-tetramethyl-4-piperidinyl esters (fatty acid mixture), SABO, CAS 61788-62-3, total amine value 128-137 mg KOH/g) and 2.5 wt. % actives of a boron post-treated succinimide dispersant derived from ~1300 MW PIBSA and heavy polyamine. The lubricating oil composition had a total 540 ppm of boron from the borated sulfonate, organic friction modifier, and borated dispersant.

Comparative Example 12

The formulation baseline was duplicated except the presence of 0.30 wt. % of Armeen® MHTL8 (2-Ethylhexyl, hydrogenated tallowalkylmethylamines, Akzo Nobel, total amine value 141 mg KOH/g) and 2.5 wt. % actives of a boron post-treated succinimide dispersant derived from ~1300 MW PIBSA and heavy polyamine. The lubricating oil composition had a total 540 ppm of boron from the borated sulfonate, organic friction modifier, and borated dispersant.

ASTM D6594 HTCBT (High Temperature Corrosion Bench Test)

The ASTM D6594 HTCBT test is used to test diesel engine lubricants to determine their tendency to corrode various metals, specifically alloys of lead and copper commonly used in cam followers and bearings. Four metal specimens of copper (Cu), lead (Pb), tin (Sn) and phosphor bronze are immersed in a measured amount of engine oil. The oil, at an elevated temperature (170° C.), is blown with air (51/h) for a period of time (168 h). When the test is completed, the copper specimen and the stressed oil are examined to detect corrosion and corrosion products, respectively. The concentrations of copper, lead, and tin in the new oil and stressed oil and the respective changes in metal concentrations are reported. To be a pass for API heavy duty categories, the concentration of lead should not exceed 120 ppm and copper should not exceed 20 ppm. A copy of this test method can be obtained from ASTM International at 100 Barr Harbor Drive, PO Box 0700, West Conshohocken, Pa. 19428-2959 and is herein incorporated for all purposes. Results of the HTCHT are given below in Tables 2 and 3.

Copper Strip Corrosion Test—ASTM D130

Crude petroleum contains sulfur compounds, most of which are removed during refining. However, of the sulfur compounds remaining in the petroleum product, some can have a corroding action on various metals and this corrosivity is not necessarily related directly to the total sulfur content. The effect can vary according to the chemical types of sulfur compounds present. The copper strip corrosion test is designed to assess the relative degree of corrosivity of a petroleum product. In this test, a polished copper strip is immersed in a specific volume of the sample being tested and heated under conditions of temperature and time that are specific to the class of material being tested. At the end of the heating period, the copper strip is removed, washed and the color and tarnish level assessed against the ASTM Copper Strip Corrosion Standard Summarized Below (Table 1).

TABLE 1

ASTM D130-04: Copper Strip Classifications

| Classification Freshly polished strip[2] | Designation | Description[1] |
|---|---|---|
| 1 | Slight tarnish | a. Light orange<br>b. Dark Orange |
| 2 | Moderate tarnish | a Claret red<br>b. Lavender<br>c. Multicolored with lavender blue or silver or both, overlaid on claret red<br>d. Silvery<br>e. Brassy or Gold |
| 3 | Dark tarnish | a. Magenta overcast on brassy strip<br>b. Multicolored with red and green showing (peacock), but no gray |
| 4 | Corrosion | a. Transparent black, dark gray or brown with peacock green barely showing<br>b. Glossy or jet black |

[1]The ASTM Copper Strip Corrosion Standard is a colored reproduction of strips characteristic of these descriptions.
[2]The freshly polished strip is included in the series only as an indication of the appearance of a properly polished strip before a test run; it is not possible to duplicate this appearance after a test even with a completely noncorrosive sample.

The corrosion property of Examples 1-9 and Comparative Examples 1-12 were evaluated in the both the HTCBT and Copper Strip Corrosion Test. These results are given in Tables 2 and 3. It is evident that Examples 1-9 provided superior performance on both copper corrosion and copper strip rating as compared to Comparative Examples 1-12.

TABLE 2

| | Ex. 1 | Ex. 2 | Ex. 3 | Ex. 4 | Ex. 5 | Ex. 6 | Comp. Ex. 1 | Comp. Ex. 2 | Comp. Ex. 3 | Comp. Ex. 4 |
|---|---|---|---|---|---|---|---|---|---|---|
| Cu (ppm) | 10 | 14 | 8 | 9 | 9 | 8 | 47 | 37 | 45 | 49 |
| Pb (ppm) | 65 | 50 | 111 | 126 | 98 | 87 | 61 | 47 | 45 | 46 |
| Sn (ppm) | 2 | 0 | 0 | 0 | 0 | 0 | 0 | 1 | 0 | 1 |
| Cu Strip rating | 1b | 1b | 1b | 1b | 1b | 1b | 3a | 3a | 3a | 3a |

*Results are the average of two runs

TABLE 3

| | Ex. 7 | Ex. 8 | Ex. 9 | Comp. Ex. 5 | Comp. Ex. 6 |
|---|---|---|---|---|---|
| Cu (ppm) | 10 | 11 | 12 | 45 | 36 |
| Pb (ppm) | 78 | 139 | 86 | 36 | 49 |
| Sn (ppm) | 0 | 0 | 0 | 0 | 0 |
| Cu Strip rating | 1b | 1b | 1b | 3a | 3a |

TABLE 3-continued

| | Comp. Ex. 7 | Comp. Ex. 8 | Comp. Ex. 9 | Comp. Ex. 10 | Comp. Ex. 11 | Comp. Ex. 12 |
|---|---|---|---|---|---|---|
| Cu (ppm) | 24 | 39 | 66 | 42 | 42 | 55 |
| Pb (ppm) | 58 | 58 | 55 | 50 | 42 | 60 |
| Sn (ppm) | 2 | 0 | 0 | 0 | 1 | 0 |
| Cu Strip rating | 2c | NM | 3b | 3a | 3a | 3a |

*Results are the average of two runs

What is claimed is:

1. An internal combustion engine lubricating oil composition which comprises:

(a) a major amount of an oil of lubricating viscosity;

(b) an oil soluble or oil dispersible borated hydrocarbyl succinimide dispersant, wherein the hydrocarbyl group has a number average molecular weight of greater than 1150 to about 5000; and (c) 0.1 to 5%, based on the total weight of the lubricating oil composition, of an oil soluble or oil dispersible tertiary hydrocarbylamine compound, wherein the tertiary hydrocarbylamine compound is a compound represented by a structure of formula (2):

$$R^8R^9R^{10}N \quad (2)$$

wherein at least one of $R^8$, $R^9$ and $R^{10}$ is a $C_1$-$C_6$ hydrocarbyl group and the other two $R^8$, $R^9$ and $R^{10}$ are a saturated or unsaturated $C_8$-$C_{20}$ hydrocarbyl group or an alkyl di-alkanolamine represented by a structure of formula (3):

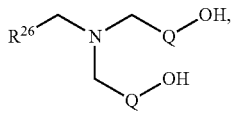

(3)

wherein $R^{26}$ has from 6 to 22 carbon atoms and where Q is a $C_1$ to $C_4$ linear or branched alkylene group, wherein the boron content of the lubricating oil composition is at least 50 ppm to less than about 470 ppm.

2. The composition of claim 1, wherein the tertiary hydrocarbylamine is the compound of formula (2)

wherein the other two $R^8$, $R^9$, and $R^{10}$ are the same or different and each individually are selected from the group consisting of straight-chain or branched, saturated or unsaturated $C_{12}$-$C_{20}$ hydrocarbyl group.

3. The composition of claim 1, wherein the tertiary amine has a weight average molecular weight of from 100 to 1200.

4. The composition of claim 1, wherein in the alkyl di-alkanolamine (Formula 3)

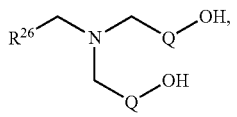

$R^{26}$ has from 8 to 18 carbon atoms.

5. The composition of claim 1, wherein the tertiary hydrocarbylamine compound has a TBN value of at least 20 mg KOH/g when tested according to ASTM D2896.

6. The composition of claim 1, wherein the hydrocarbyl group is derived from a polymer of a $C_3$ or $C_4$ monoolefin, especially a polyisobutylene, wherein the polyisobutenyl group has a number average molecular weight (Mn) of from 700 to 5,000.

7. The composition of claim 1, wherein the borated hydrocarbyl succinimide dispersant is a polyisobutylene succinimide dispersant.

8. The composition of claim 1, wherein the borated hydrocarbyl succinimide dispersant is derived from a polyamine having from 2 to 60 carbon atoms and from 2 to 12 nitrogen atoms per molecule.

9. The composition of claim 8, wherein the polyamine is a polyalkyleneamines represented by the formula (1):

$$NH_2(CH_2)_n—(NH(CH_2)_n)_m—NH_2, \quad \text{Formula (1)}$$

wherein n is 2 to 3 and m is 0 to 10.

10. The composition of claim 1, wherein the borated hydrocarbyl succinimide dispersant contains at least 1 succinic group for each polyisobutenyl group.

11. The composition of claim 1, comprising 0.1 to 3 wt. %, based on the total weight of the lubricating oil composition, of the oil soluble or oil dispersible tertiary hydrocarbylamine compound.

12. The composition of claim 1, further comprising a borated sulfonate, and a borated organic friction modifier.

13. The composition of claim 1, wherein the composition further comprises a boron containing additive selected from the group consisting of a borated friction modifier; a dispersed alkali metal or a mixed alkali metal or an alkaline earth metal borate, a borated epoxide, a borate ester, a borated fatty amine, a borated amide, and a borated detergent.

14. The composition of claim 1, wherein the hydrocarbyl group of the an oil soluble or oil dispersible borated hydrocarbyl succinimide dispersant has a number average molecular weight of greater than 1150 to about 2500.

* * * * *